US011766375B2

(12) United States Patent
Ko

(10) Patent No.: US 11,766,375 B2
(45) Date of Patent: Sep. 26, 2023

(54) HARMONIC VIBRATION FITNESS MACHINE CAPABLE OF REALIZING SINGLE PLATFORM DOUBLE AMPLITUDE OPERATION

(71) Applicant: B.Green Health Technology Co., Ltd., Taichung (TW)

(72) Inventor: Yi-Ling Ko, Changhua County (TW)

(73) Assignee: B.GREEN HEALTH TECHNOLOGY CO., LTD., Taichung (TW)

( * ) Notice: Subject to any disclaimer, the term of this patent is extended or adjusted under 35 U.S.C. 154(b) by 551 days.

(21) Appl. No.: 17/080,230

(22) Filed: Oct. 26, 2020

(65) Prior Publication Data

US 2022/0071830 A1 Mar. 10, 2022

(30) Foreign Application Priority Data

Sep. 9, 2020 (TW) ..... 109130983

(51) Int. Cl.
*A61H 1/00* (2006.01)
*A61H 23/02* (2006.01)

(52) U.S. Cl.
CPC ..... *A61H 1/005* (2013.01); *A61H 23/0263* (2013.01); *A61H 2023/0272* (2013.01); *A61H 2201/149* (2013.01)

(58) Field of Classification Search
CPC ..... A61H 1/00; A61H 1/005; A61H 1/001; A61H 23/00; A61H 23/0263; A61H 23/0254; A61H 2023/0272; A61H 2201/149; A61H 2201/1436; A61H 2201/1207; A61H 2201/5035
See application file for complete search history.

(56) References Cited

U.S. PATENT DOCUMENTS 3,326,209 A * 6/1967 Mandl ..... A63B 22/16 601/87
10,016,328 B1 * 7/2018 Treat ..... A61H 1/005
(Continued)

FOREIGN PATENT DOCUMENTS

KR 100484670 B1 * 4/2005
KR 20060042332 A * 5/2006
(Continued)

*Primary Examiner* — Timothy A Stanis
*Assistant Examiner* — Matthew R Moon
(74) *Attorney, Agent, or Firm* — MUNCY, GEISSLER, OLDS & LOWE, P.C.

(57) ABSTRACT

A harmonic vibration fitness machine includes a base, a platform, a movable plate, a first drive unit and a second drive unit. The first drive unit uses a first motor to drive two first linkages through a first transmission shaft and a reduction gear set, so that the first linkages drive a platform to move up and down. The second drive unit uses a second motor to drive to second linkages through a second transmission shaft and a reduction gear set, so that the second linkages drive the movable plate to move up and down. The movable plate will be linked with the first linkages during the operation process, so that the up and down movement of the platform can be multiplied. So, the harmonic vibration fitness machine can achieve the effect of single platform and double amplitude action.

10 Claims, 10 Drawing Sheets

(56) References Cited

U.S. PATENT DOCUMENTS

| | | | | |
|---|---|---|---|---|
| 2004/0230142 | A1* | 11/2004 | Park | A47C 21/006 601/51 |
| 2006/0217640 | A1* | 9/2006 | Trandafir | A61H 1/001 601/84 |
| 2007/0207900 | A1* | 9/2007 | Huang | A63B 26/003 482/51 |
| 2020/0000669 | A1* | 1/2020 | Tsai | A61H 1/005 |

FOREIGN PATENT DOCUMENTS

| | | | | |
|---|---|---|---|---|
| TW | I660762 | B | 6/2019 | |
| WO | WO-2007112653 | A1 * | 10/2007 | A61H 1/003 |

* cited by examiner

HARMONIC VIBRATION FITNESS MACHINE CAPABLE OF REALIZING SINGLE PLATFORM DOUBLE AMPLITUDE OPERATION

BACKGROUND OF THE INVENTION

1. Field of the Invention

The present invention relates to fitness machine technology, and more particularly to a harmonic vibration fitness machine that can realize single platform double amplitude operation.

2. Description of the Related Art

The reciprocating vibration type harmonic vibration fitness machine disclosed in Taiwan Patent Publication No. 1660762 uses an actuating mechanism to simultaneously drive related components, and causes the platform components to move up and down relative to each other to produce the effect of body harmonic vertical vibration. However, the aforementioned patent documents only provide a single-amplitude operation mode, which is too monotonous in use and has little change, so the variability of the harmonic vibration that can be provided is limited, so there is room for improvement.

SUMMARY OF THE INVENTION

The present invention has been accomplished under the circumstances in view. It is the main object of the present invention to provide a harmonic vibration fitness machine that can realize single platform double amplitude operation, so that the variability of harmonic vibration usage can be multiplied.

To achieve this and other objects of the present invention, a harmonic vibration fitness machine comprises a machine body, a movable plate, a first drive unit, two first linkages, a second drive unit and two second linkages. The machine body comprises a base and a platform. The base comprises an upward accommodating space. The movable plate is set in the accommodating space and movable up and down relative to the base by the second linkages. The platform is set above the movable plate and drivable by the first linkages to move up and down.

From the above we can see that the harmonic vibration fitness machine of the present invention uses the first drive unit and the second drive unit to drive the first linkages and the second linkages respectively. On the one hand, the first linkages move the platform, one the other hand, the second linkages move the movable plate. Then the movable plate will also move the first linkages during the operation process, so that the up and down movement of the platform can obtain an additive effect. In this way, when the user puts his feet or other body parts on the platform, he can feel the double-amplitude vibration, so that the whole body can achieve the purpose of massage and fitness.

Preferably, each first linkage comprises a first support rod, a second support rod, a first upper transverse rod, a first lower transverse rod, a first adapter, a second adapter, a first vertical rod, a second vertical rod and a first drive rod. The bottom end of the first support rod and the bottom end of the second support rod are affixed to the top surface of the movable plate. The first upper transverse rod is pivoted to the opposing top end of the first support rod. The first lower transverse rod is pivoted to the opposing top end of the second support rod. The top end of the first adapter is affixed to the bottom surface of the platform. The bottom end of the first adapter is pivoted to the first upper transverse rod. The top end of the second adapter is affixed to the bottom surface of the platform. The bottom end of the second adapter is pivoted to the top end of the second vertical rod. The bottom end of the second vertical rod is pivoted to the first lower transverse rod. The opposing top and bottom ends of the first vertical rod are respectively pivoted to the inner end of the first upper transverse rod and the inner end of the first lower transverse rod. The first drive rod is located between the first support rod and the first vertical rod. The top end of the first drive rod is pivoted to the first upper transverse rod. The bottom end of the first drive rod is connected to an eccentric shaft at a respective one end of the first transmission shaft. With the above technical features, when the bottom end of the first drive rod is driven by the first transmission shaft, the first upper transverse rod is driven to swing up and down on the top end of the first support rod like a seesaw. Then, the first upper transverse rod drives the first adapter and the first vertical rod to move up and down, thereby causing the first vertical rod to drive the first lower transverse rod to swing up and down on the top end of the second support rod like a seesaw. Then, the first lower transverse rod drives the second vertical rod to move the second adapter and the first adapter synchronously up and down, causing the platform to move up and down.

Preferably, the top end of the first adapter and the top end of the second adapter are both affixed to a rack. The rack is affixed to the bottom surface of the platform so that the first linkages drive the rack to move the platform up and down.

Preferably, each second linkage comprises at least one third support rod, a fourth support rod, a third vertical rod, a second upper transverse rod, a second lower transverse rod, a third adapter, a fourth adapter, a second drive rod and a fourth vertical rod. The top end of the third support rod is pivoted to the second lower transverse rod. The opposing bottom end of the third support rod is affixed to the base. The top end of the fourth support rod is pivoted to the second upper transverse rod. The opposing bottom end of the fourth support rod is affixed to the base. The top end of the third vertical rod is pivoted to the outer end of the second upper transverse rod. The opposing bottom end of the third vertical rod is pivoted to the top end of the third adapter. The opposing bottom end of the third adapter is affixed to the top surface of the movable plate. The top end of the fourth adapter is pivoted to the outer end of the second lower transverse rod. The opposing bottom end of the fourth adapter is affixed to the top surface of the movable plate. The top end of the second drive rod is pivoted to the second lower transverse rod. The opposing bottom end of the second drive rod is coupled to an eccentric shaft at a respective one end of the second transmission shaft. The opposing top and bottom ends of the fourth vertical rod are respectively pivoted to the inner end of the second upper transverse rod and the inner end of the second lower transverse rod. With the above technical features, the second drive rod will drive the second lower transverse rod to swing up and down on the top end of the third support rod as a seesaw when the bottom end of the second drive rod is driven by the second transmission shaft. When the second lower transverse rod to swings up and down, it moves the fourth adapter and the fourth vertical rod, on the one hand making the fourth adapter to reciprocate up and down relative to the base, on the other hand causing the fourth vertical rod to swing up and down on the top end of the fourth support rod as a seesaw. During swinging of the second upper transverse rod, the third vertical rod drives the third adapter, causing the third adapter and the fourth adapter to synchronously reciprocate the movable plate up and down relative to the base.

Preferably, the movable plate has a large opening and a small opening. The large opening accommodates the second transmission shaft, the second transmission shaft bearing blocks, the third support rods and the fourth support rods. The small opening accommodates the fourth support rods. With the above technical features, the movable plate will not interfere with the aforementioned components when moving up and down.

Preferably, the first motor can be selectively mounted on the base or the movable plate according to actual needs, and the second motor is mounted on the base.

The detailed structure, characteristics, assembly or use of the harmonic vibration fitness machine provided by the present invention will be described in the subsequent detailed description of the preferred embodiment. However, those with ordinary skill in the art should be able to understand that the detailed description and the specific preferred embodiment listed in the implementation of the present invention are only used to illustrate the present invention, not to limit the scope of patent applications for this invention.

DETAILED DESCRIPTION OF THE INVENTION

Figure 1:
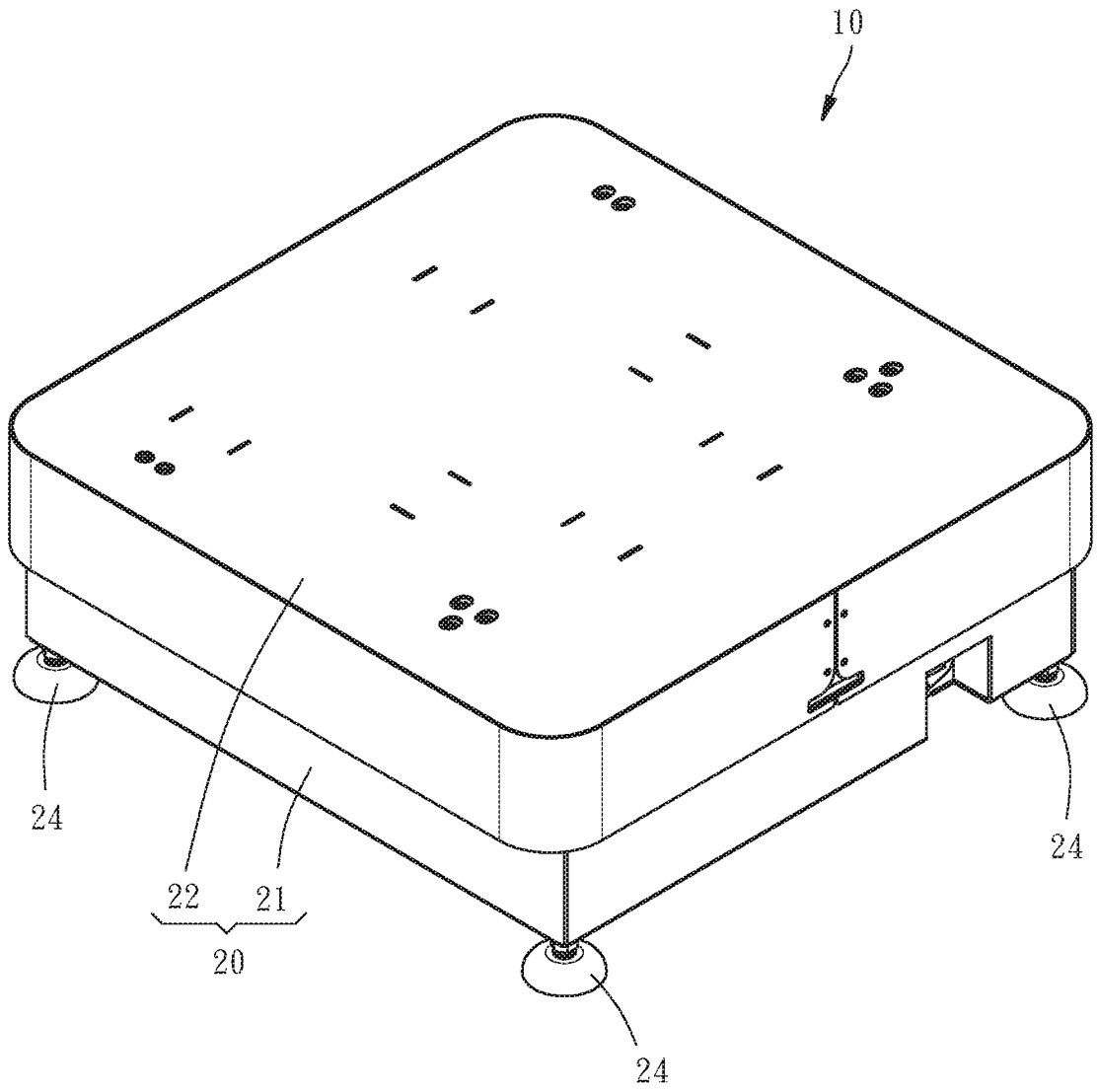
FIG. 1 is an oblique top elevational view of a harmonic vibration fitness machine in accordance with the present invention.

The applicant first states here that throughout the specification, including the preferred embodiment described below and the claims in the scope of patent application, the terms related to directionality are based on the directions in the drawings. Secondly, in the preferred embodiment and drawings to be described below, the same element numbers represent the same or similar elements or their structural features.

Figure 2:
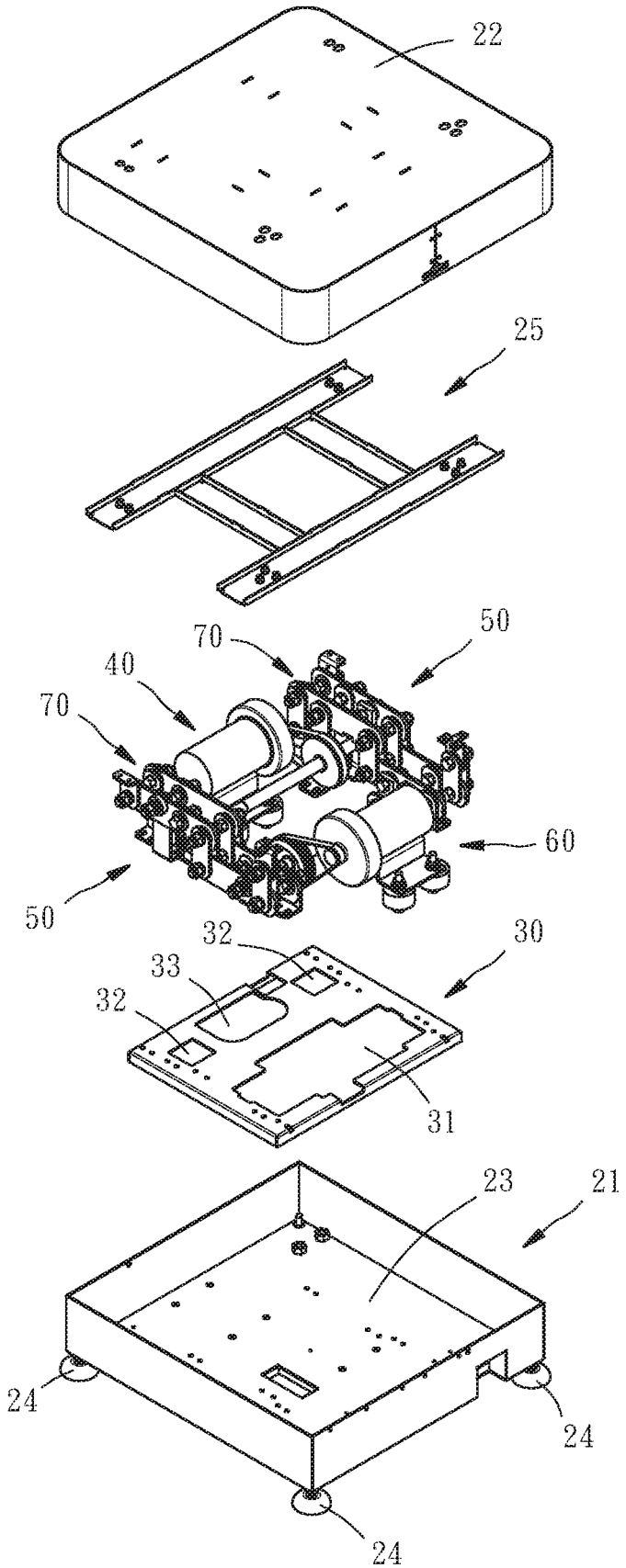
FIG. 2 is an exploded view of the harmonic vibration fitness machine in accordance with the present invention.

Referring to FIGS. 1 and 2, a harmonic vibration fitness machine 10 provided by the present invention comprises a machine body 20, a movable plate 30, a first drive unit 40, two first linkages 50, a second drive unit 60, and two second linkages 70.

As shown in FIG. 2, the machine body 20 comprises a base 21, and a platform 22 for the harmonic vibration of the body of the user. The base 21 has an upward accommodating space 23, and the four corners of the base 21 are respectively supported on the ground by a foot pad 24. The platform 22 is located above the accommodating space 23 and can move up and down relative to the base 21.

The movable plate 30 is set in the accommodating space 23 and can be moved up and down relative to the base 21 by an external force. As shown in FIG. 2, the movable plate 30 has a large opening 31, two small openings 32, and a medium opening 33 located between the two small openings 32.

Figure 3:
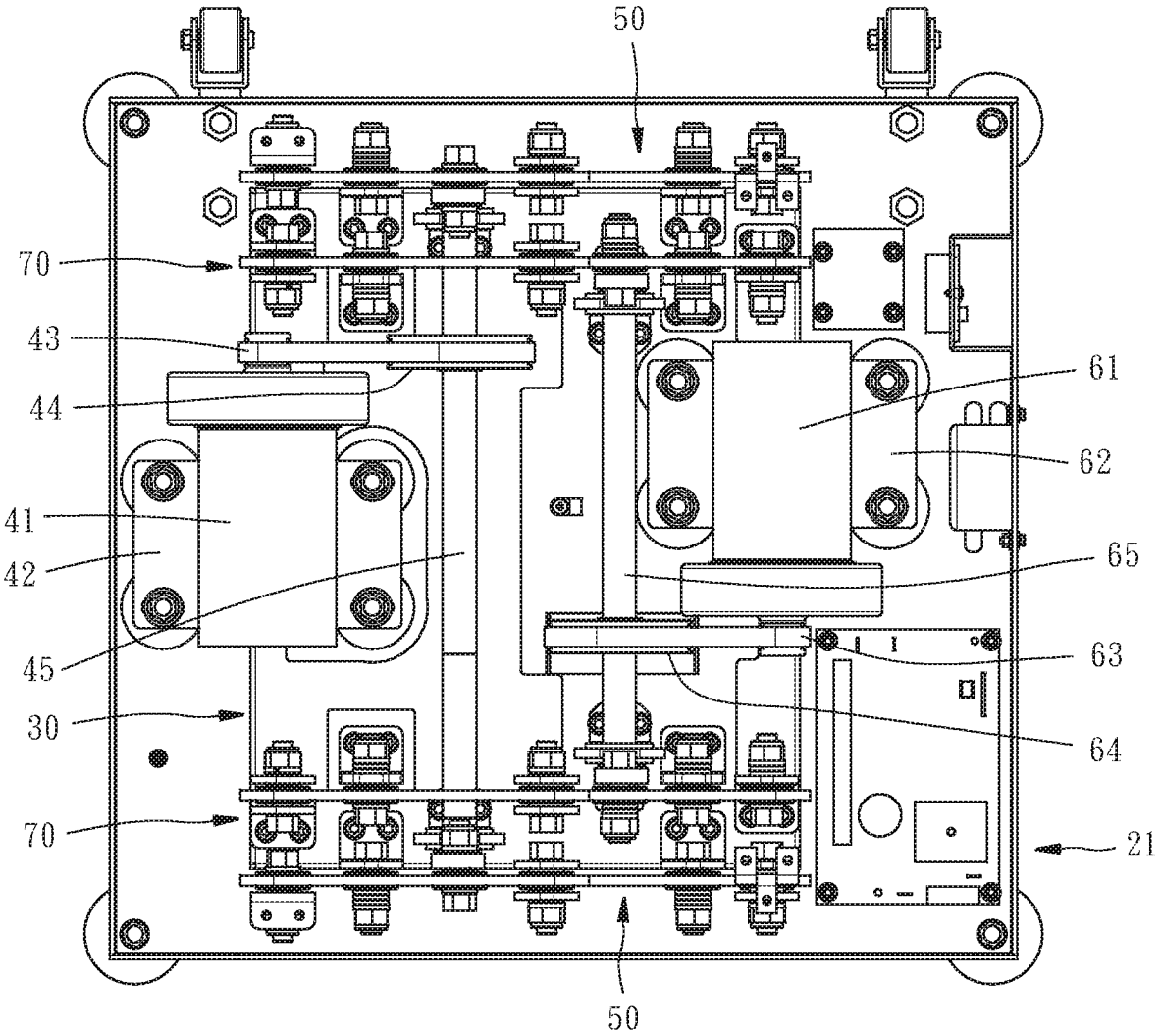
FIG. 3 is a top view of the harmonic vibration fitness machine in accordance with the present invention where the platform and the rack are omitted.
Figure 4:
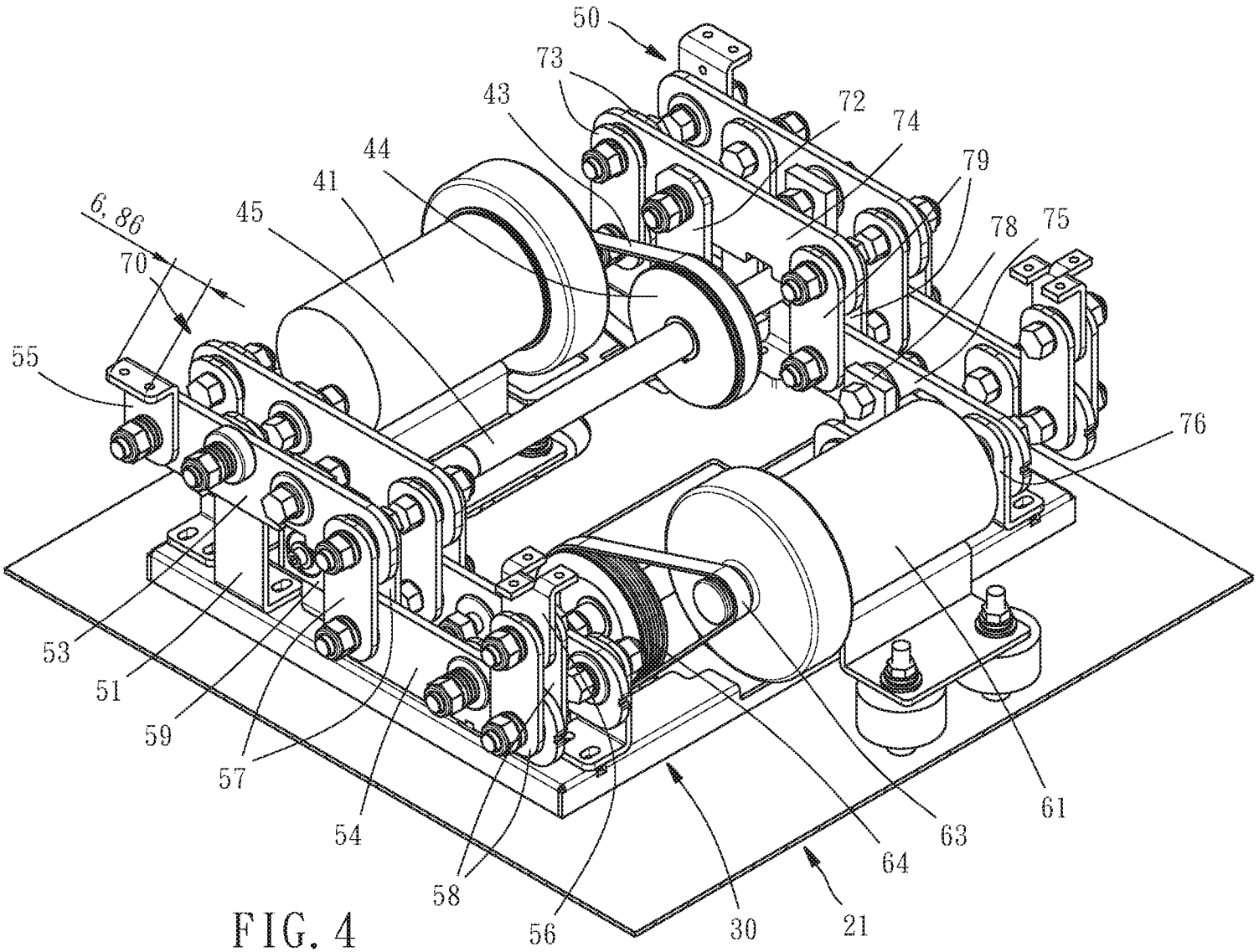
FIG. 4 is an elevational view of a part of the harmonic vibration fitness machine in accordance with the present invention.
Figure 5:
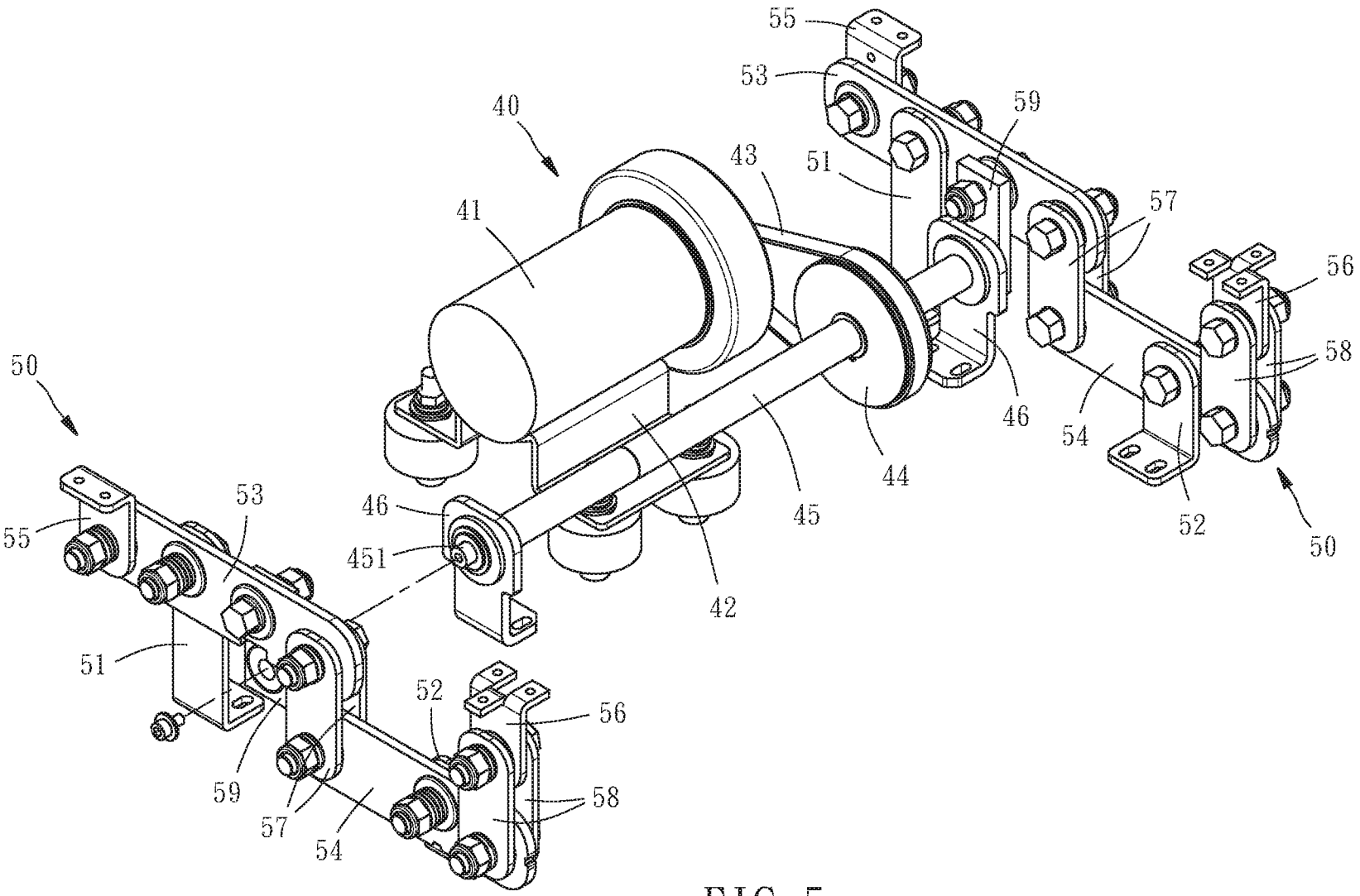
FIG. 5 is an exploded view of a part of the first drive unit and the first linkages of the harmonic vibration fitness machine in accordance with the present invention.
Figure 6:
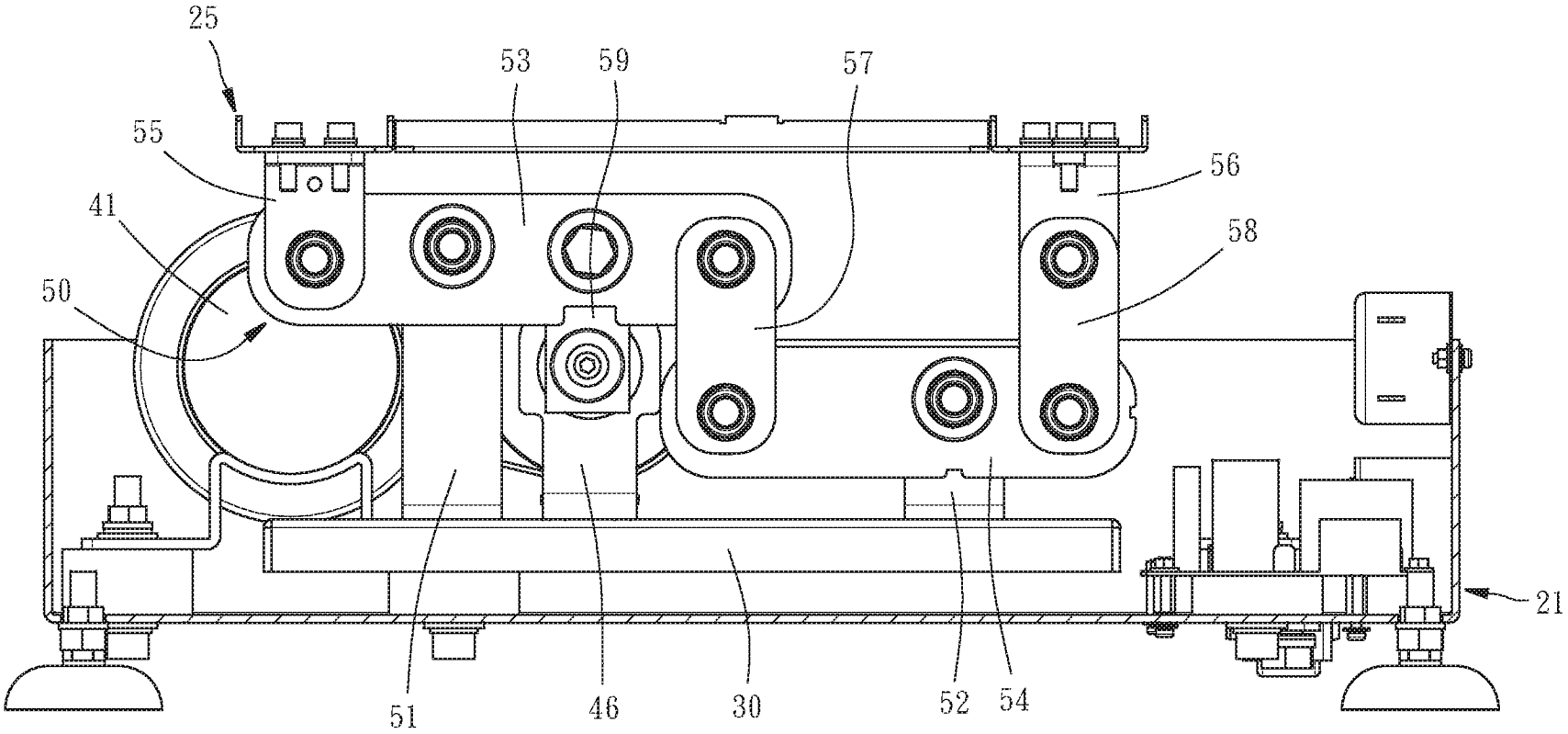
FIG. 6 is a plain view of the first linkage of the harmonic vibration fitness machine in accordance with the present invention.

As shown in FIGS. 2-4, the first drive unit 40 is set in the accommodating space 23, comprising a first motor 41. The first motor 41 is mounted on a first bracket 42 that straddles the movable plate 30. The first bracket 42 has one end thereof inserted through the medium opening 33 of the movable plate 30 and affixed to the base 21, and an opposite end thereof directly affixed to the base 21. However, in fact, the first motor 41 can be assembled on the movable plate 30 according to actual needs. As shown in FIGS. 3-5, the first motor 41 is connected to the first pulley 44 through a first belt 32 as a reduction gear set. The first pulley 44 is fixed to a first transmission shaft 45 above the movable plate 30, so that the first transmission shaft 45 can be driven by the first motor 41 to rotate. In addition, the first drive unit 40 further comprises two first transmission shaft bearing blocks 46. Each first transmission shaft bearing block 46 is sleeved on a respective one end of the first transmission shaft 45 in a coaxial manner, and each first transmission shaft bearing block 46 is affixed to the top surface of the movable plate 30 with its bottom end to serve as a support for the first transmission shaft 45.

The two first linkages 50 are set on two opposite sides of the first motor 41. As shown in FIGS. 3-5, each first linkage 50 comprises at least one first support rod 51, a second support rod 52, a first upper transverse rod 53, a first lower transverse rod 54, a first adapter 55, a second adapter 56, a first vertical rod 57, a second vertical rod 58 and a first drive rod 59. The bottom end of the first support rod 51 and the bottom end of the second support rod 52 are affixed to the top surface of the movable plate 30. The first upper transverse rod 53 is pivoted to the top end of the first support rod 51. The first lower transverse rod 54 is pivoted to the top end of the second support rod 52. The top end of the first adapter 55 and the top end of the second adapter 56 are affixed to a rack 25. The rack 25 is affixed to the bottom surface of the platform 22 as a support. The opposing bottom end of the first adapter 55 is pivoted to the outer end of the first upper transverse rod 53. The opposing bottom end of the second adapter 56 is pivoted to the top end of the second vertical rod 58. The opposing bottom end of the second vertical rod 58 is pivoted to the outer end of the first lower transverse rod 54. The opposing top and bottom ends of the first vertical rod 57 are respectively pivoted to the opposing inner end of the first upper transverse rod 53 and the opposing inner end of the first lower transverse rod 54. The first drive rod 59 can be pivoted to any location of the respective first linkage beyond the pivot connection between the first upper transverse rod 53 and the first support rod 51 or beyond the pivot connection between the first lower transverse rod 54 and the second support rod 52. Especially, the first drive rod 59 can be pivoted to the first upper transverse rod 53 or the first lower transverse rod 54 to achieve the same drive effect. In the present preferred embodiment, the first drive rod 59 is located between the first support rod 51 and the first vertical rod 57. The first drive rod 59 has the top end thereof pivoted to the first upper transverse rod 53 and the opposing bottom end thereof connected to a distal end of an eccentric shaft 451 of the first transmission shaft 45.

Figure 7:
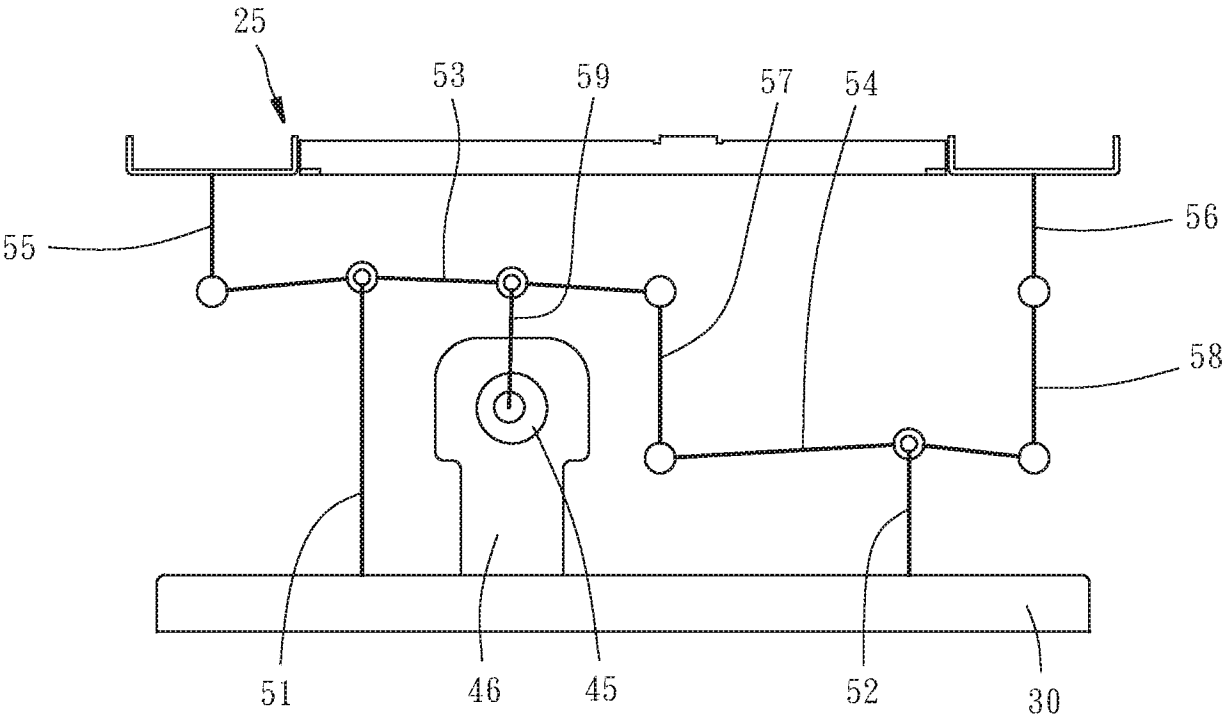
FIG. 7 is a connecting rod diagram of the first linkage of the harmonic vibration fitness machine in accordance with the present invention.

As shown in FIG. 7, when the bottom end of the first drive rod 59 is driven by the first transmission shaft 45, the first drive rod 59 will drive the first upper transverse rod 53 to swing up and down like a seesaw on the top of the first support rod 51 due to the eccentricity. During up and down swinging of the first upper transverse rod 53, it drives the first adapter 55 and the first vertical rod 57, on the one hand making the first adapter 55 to reciprocate up and down relative to the base 21, on the other hand causing the first vertical rod 57 to drive the first lower transverse rod 54 to swing up and down on the top end of the second support rod 52 like a seesaw. During up and down swinging of the first lower transverse rod 54, the second vertical rod 58 is driven to carry the second adapter 56 up and down. Thus, the second adapter 56 and the first adapter 55 are synchronously moved up and down, and the rack 25 is driven to reciprocate the platform 22 up and down relative to the base 21.

Figure 8:
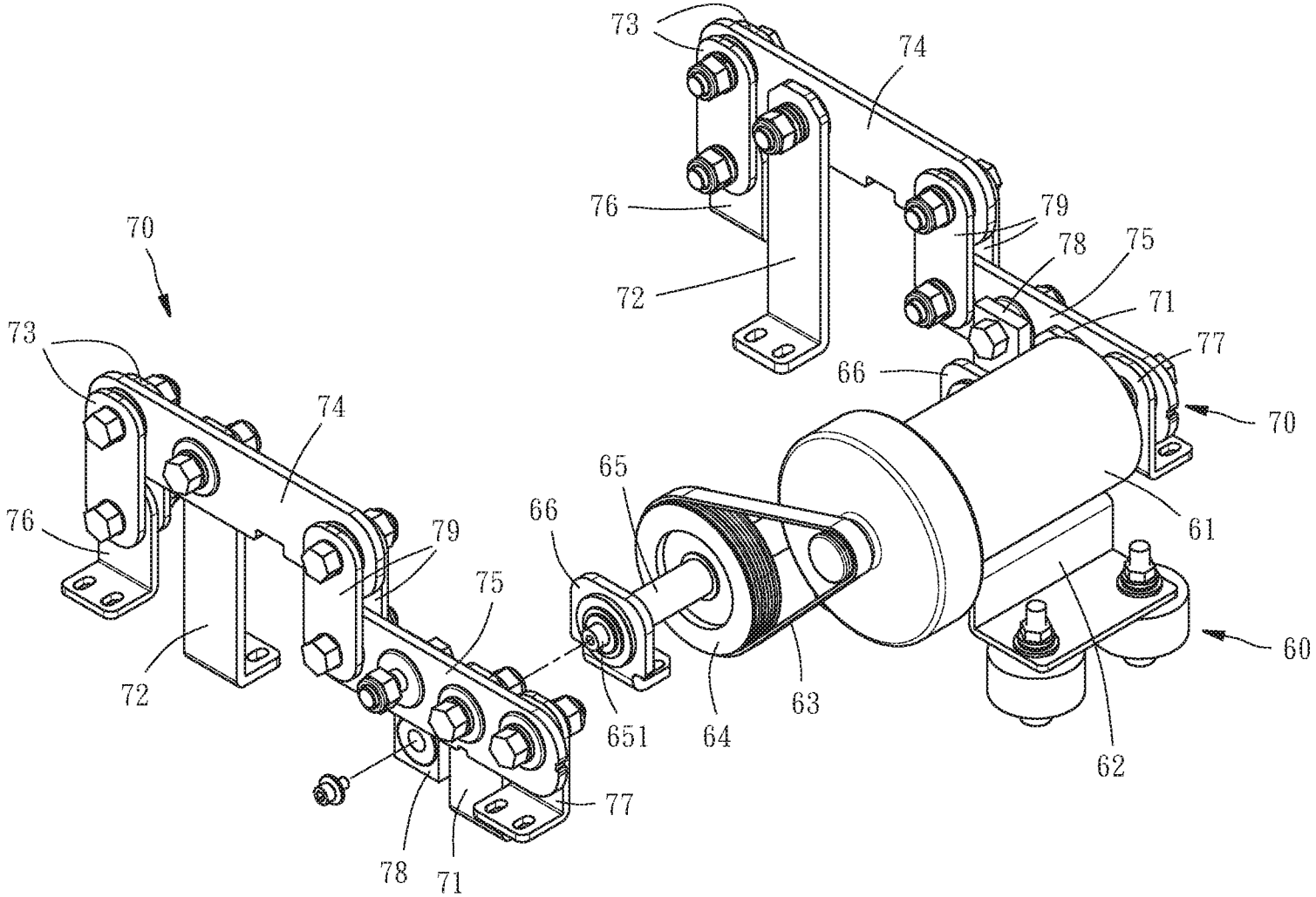
FIG. 8 is an exploded view of a part of the second drive unit and the second linkage of the harmonic vibration fitness machine in accordance with the present invention.

The second drive unit 60 is set in the accommodating space 23. As shown in FIGS. 3, 4 and 8, the second drive unit 60 comprises a second motor 61. The second motor 61 is mounted on a second bracket 62 that straddles the movable plate 30. The second bracket 62 has one end thereof inserted through the large opening 31 of the movable plate 30 and affixed to the base 21, and an opposite end thereof directly affixed to the base 21. The second motor 61 is connected to a second pulley 64 through a second belt 64 as a reduction gear set. The second pulley 64 is fixed to a second transmission shaft 65 accommodating in the large opening 31 of the movable plate 30, so that the second transmission shaft 65 can be driven by the second motor 61 to rotate. In addition, the second drive unit 60 further comprises two second transmission shaft bearing blocks 66. Each second transmission shaft bearing block 66 is sleeved on a respective one end of the second transmission shaft 65 in a coaxial manner, and each second transmission shaft bearing block 66 is affixed to the base 21 with its bottom end to serve as a support for the second transmission shaft 65.

Figure 9:
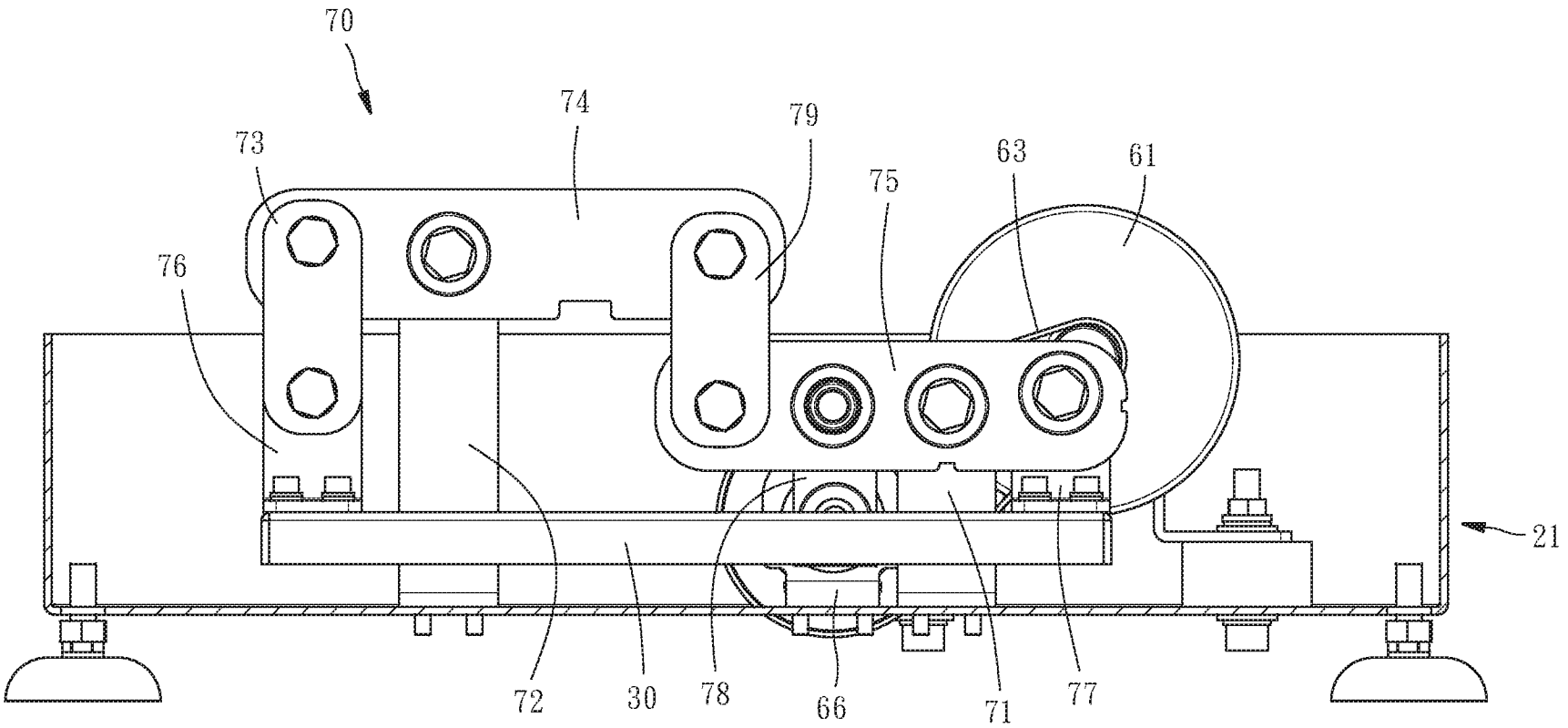
FIG. 9 is a plain view of the second linkage of the harmonic vibration fitness machine in accordance with the present invention.

The two second linkages 70 are set on two opposite sides of the second motor 61 at an inner side relative to the two first linkages 50. As shown in FIGS. 8 and 9, each second linkage 70 comprises at least one third support rod 71, a fourth support rod 72, a third vertical rod 73, a second upper transverse rod 74, a second lower transverse rod 75, a third adapter 76, a fourth adapter 77, a second drive rod 78 and a fourth vertical rod 79. The top end of the third support rod 71 is pivoted to the second lower transverse rod 75. The bottom end of the third support rod 71 is inserted through the large opening 31 of the movable plate 30 and affixed to the base 21. The top end of the fourth support rod 72 is pivoted to the second upper transverse rod 74. The bottom end of the fourth support rod 72 is inserted through the small opening 32 of the movable plate 30 and affixed to the base 21. The top end of the third vertical rod 73 is pivoted to the outer end of the second upper transverse rod 74. The bottom end of the third vertical rod 73 is pivoted to the top end of the third adapter 76. The bottom end of the third adapter 76 is affixed to the top surface of the movable plate 30. The top end of the fourth adapter 77 is pivoted to the outer end of the second lower transverse rod 75. The bottom end of the fourth adapter 77 is affixed to the top surface of the movable plate 30.

The second drive rod 78 can be pivoted to any location of the respective second linkage beyond the pivot connection between the second upper transverse rod 74 and the fourth support rod 72 or beyond the pivot connection between the second lower transverse rod 75 and the third support rod 71. Especially, the second drive rod 78 can be pivoted to the second upper transverse rod 74 or the second lower transverse rod 75 to achieve the same drive effect. In the present preferred embodiment, the second drive rod 78 has the top end thereof pivoted to the second lower transverse rod 75 and the opposing bottom end thereof connected to a distal end of an eccentric shaft 651 of the second transmission shaft 65. The opposing top and bottom ends of the fourth vertical rod 79 are respectively pivoted to the inner end of the second upper transverse rod 74 and the inner end of the second lower transverse rod 75.

Figure 10:
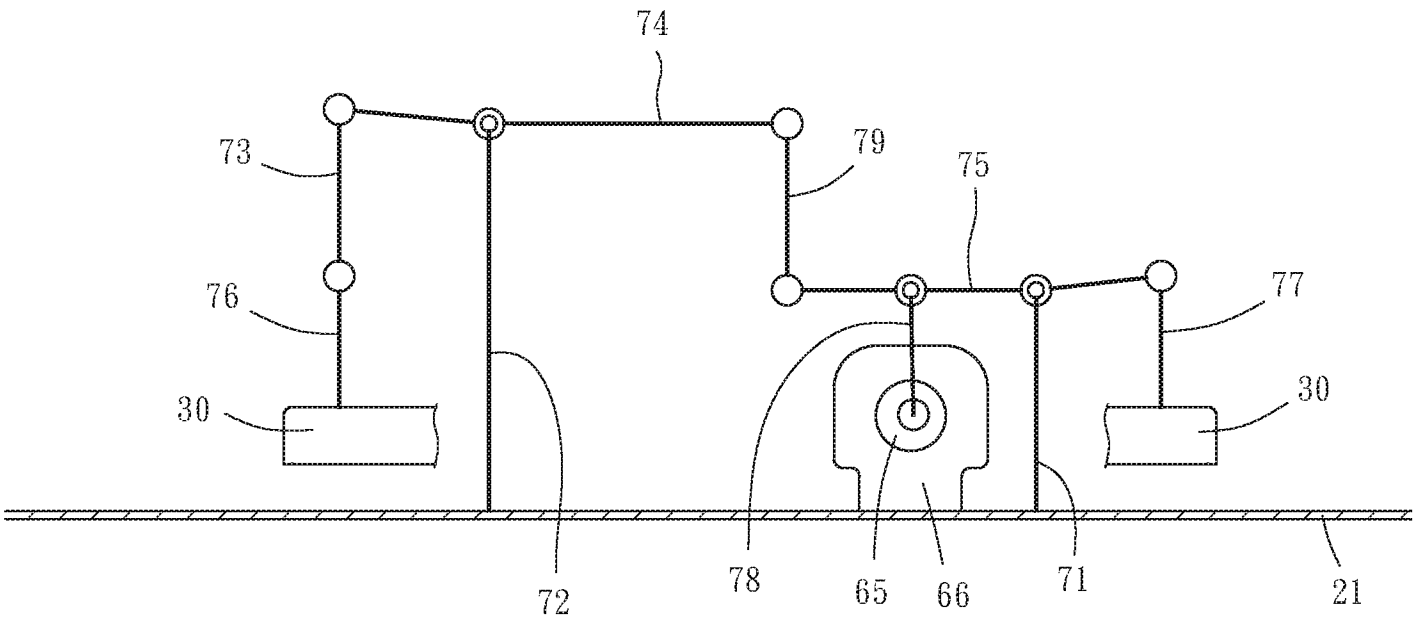
FIG. 10 is a connecting rod diagram of the second linkage of the harmonic vibration fitness machine in accordance with the present invention.

As a result, as shown in FIG. 10, when the bottom end of the second drive rod 78 is driven by the second transmission shaft 65, the second drive rod 78 will drive the second lower transverse rod 75 to swing up and down like a seesaw on the top of the third support rod 71 due to the eccentricity. During up and down swinging of the second lower transverse rod 75, it drives the fourth adapter 77 and the fourth vertical rod 79, on the one hand making the fourth adapter 77 to reciprocate up and down relative to the base 21, on the other hand causing the fourth vertical rod 79 to drive the second upper transverse rod 74 to swing up and down on the top end of the fourth support rod 52 like a seesaw. During up and down swinging of the second upper transverse rod 74, the third vertical rod 73 is driven to carry the third adapter 76 up and down. Thus, the third adapter 76 and the fourth adapter 77 are synchronously moved up and down, and the movable plate 30 is driven to reciprocate up and down relative to the base 21.

From the above we can see that the harmonic vibration fitness machine 10 of the present invention uses the first drive unit 40 and the second drive unit 60 to drive the first linkages 50 and the second linkages 70 respectively. On the one hand, the first linkages 50 move the platform 22, one the other hand, the second linkages 70 move the movable plate 30. Then the movable plate 30 will also move the first linkages 50 during the operation process, so that the up and down movement of the platform 22 can obtain an additive effect. In this way, when the user puts his feet or other body parts on the platform, he can feel the double-amplitude vibration, so that the whole body can achieve the purpose of massage and fitness.

What is claimed is:

1. A harmonic vibration fitness machine, comprising:

a machine body comprising a base and a platform, said base comprising an upward accommodating space, said platform being movable up and down above said accommodating space of said base;

a movable plate set in said accommodating space and movable up and down relative to said base;

a first drive unit set in said accommodating space, said first drive unit comprising a first motor, a first transmission shaft and two first transmission shaft bearing blocks, said first transmission shaft being connected to said first motor and drivable by said first motor to rotate, said first transmission shaft bearing blocks being respectively coupled to two opposite ends of said first transmission shaft and affixed to a top surface of said movable plate;

two first linkages respectively pivoted to two opposite eccentric ends of said first transmission shaft of said first drive unit and affixed to said platform and said movable plate so that said first linkages are drivable by said first drive unit to move said platform up and down relative to said movable plate;

a second drive unit set in said accommodating space, said second drive comprising a second motor, a second transmission shaft and two second transmission shaft bearing blocks, said second transmission shaft being coupled to said second motor and drivable by said second motor to rotate, said second transmission shaft bearing blocks being respectively coupled to two opposite ends of said second transmission shaft and affixed to said base; and two second linkages respectively pivoted to two opposite eccentric ends of said second transmission shaft of said second drive unit and affixed to said base and said movable plate so that said second linkages are drivable by said second drive unit to move said movable plate up and down relative to said base.

2. The harmonic vibration fitness machine as claimed in claim 1, wherein each said first linkage comprises a first support rod, a second support rod, a first upper transverse rod, a first lower transverse rod, a first adapter, a second adapter, a first vertical rod, a second vertical rod and a first drive rod, a bottom end of said first support rod and a bottom end of said second support rod being affixed to the top surface of said movable plate, said first upper transverse rod being pivoted to an opposing top end of said first support rod, said first lower transverse rod being pivoted to an opposing top end of said second support rod, a top end of said first adapter and a top end of said second adapter being both locked to a rack, said rack being affixed to a bottom surface of said platform as a support, an opposing bottom end of said first adapter being pivoted to said first upper transverse rod, an opposing bottom end of said second adapter being pivoted to a top end of said second vertical rod, an opposing bottom end of said second vertical rod being pivoted to said first lower transverse rod, said first vertical rod having opposing top and bottom ends thereof respectively pivoted to an inner end of said first upper transverse rod and an inner end of said first lower transverse rod, said first drive rod having a top end thereof pivoted to a selected location of the respective said first linkage beyond the pivot connection between said first upper transverse rod and said first support rod and beyond the pivot connection between said first lower transverse rod and said second support rod and an opposing bottom end thereof connected to a respective eccentric shaft of said first transmission shaft.

3. The harmonic vibration fitness machine as claimed in claim 2, wherein said first drive rod is located between said first support rod and said first vertical rod, the top end of said first drive rod being pivoted to said first upper transverse rod.

4. The harmonic vibration fitness machine as claimed in claim 2, wherein the top end of said first adapter and the top end of said second adapter are both affixed to a rack, said rack being affixed to the bottom surface of said platform.

5. The harmonic vibration fitness machine as claimed in claim 4, wherein said movable plate comprises a large opening adapted to accommodate said second transmission shaft, said second transmission shaft bearing blocks, said third support rods and said first drive rods, and a small opening adapted to accommodate said fourth support rods.

6. The harmonic vibration fitness machine as claimed in claim 1, wherein each said second linkage comprises at least one third support rod, a fourth support rod, a third vertical rod, a second upper transverse rod, a second lower transverse rod, a third adapter, a fourth adapter, a second drive rod and a fourth vertical rod, said third support rod having a top end thereof pivoted to said second lower transverse rod and an opposing bottom end thereof inserted through said large opening of said movable plate and affixed to said base, said fourth support rod having a top end thereof pivoted to said second upper transverse rod and an opposing bottom end thereof inserted through said small opening of said movable plate and affixed to said base, said third vertical rod having a top end thereof pivoted to an outer end of said second upper transverse rod and an opposing bottom end thereof pivoted to a top end of said third adapter, said third adapter having an opposing bottom end thereof affixed to the top surface of said movable plate, said fourth adapter having a top end thereof pivoted to an outer end of said second lower transverse rod and an opposing bottom end thereof affixed to the top surface of said movable plate, said second drive rod having a top end thereof pivotally connectable to the respective said second linkage beyond the pivot connection between said second upper transverse rod and said fourth support rod and beyond the pivot connection between said second lower transverse rod and said third support rod and an opposing bottom end thereof connected to an eccentric shaft of said second transmission shaft, said fourth vertical rod having opposing top and bottom ends thereof respectively pivoted to an opposing inner end of said second upper transverse rod and an opposing inner end of said second lower transverse rod.

7. The harmonic vibration fitness machine as claimed in claim 6, wherein said second drive rod is located between said third support rod and said fourth vertical rod, the top end of said second drive rod being pivoted to said second lower transverse rod.

8. The harmonic vibration fitness machine as claimed in claim 1, wherein said first motor is selectively mounted on said base or said movable plate.

9. The harmonic vibration fitness machine as claimed in claim 1, wherein said second motor is mounted on said base.

10. The harmonic vibration fitness machine as claimed in claim 1, further comprising a reduction gear set coupled between said first motor and said first transmission shaft of said first drive unit and a reduction gear set coupled between said second motor and said second transmission shaft of said second drive unit to increase reduction ratio.

* * * * *